US005909894A

United States Patent [19]

Meader et al.

[11] Patent Number: 5,909,894

[45] Date of Patent: Jun. 8, 1999

[54] SNOWBOARD BINDING

[75] Inventors: Allen L. Meader, Port Ochard; Geoffrey E. Rittmeyer, Vashon, both of Wash.

[73] Assignee: K-2 Corporation, Vashon, Wash.

[21] Appl. No.: 08/778,289

[22] Filed: Jan. 2, 1997

[51] Int. Cl.[6] ..... A63C 9/10

[52] U.S. Cl. ..... 280/623; 280/636; 280/602; 280/607; 441/70

[58] Field of Search ..... 280/607, 602, 280/11.14, 636, 14.2; 441/70

[56] References Cited

U.S. PATENT DOCUMENTS

| | | | |
|---|---|---|---|
| D. 346,419 | 4/1994 | Carpenter . | |
| 4,241,929 | 12/1980 | Curry . | |
| 4,896,895 | 7/1988 | Bettosini . | |
| 4,979,760 | 12/1990 | Derrah . | |
| 5,026,086 | 6/1991 | Guers et al. . | |
| 5,143,395 | 9/1992 | Mayr . | |
| 5,172,924 | 12/1992 | Barci . | |
| 5,199,734 | 4/1993 | Mayr . | |
| 5,232,241 | 8/1993 | Knott et al. . | |
| 5,261,689 | 11/1993 | Carpenter et al. . | |
| 5,356,170 | 10/1994 | Carpenter et al. . | |
| 5,409,244 | 4/1995 | Young | 280/14.2 |
| 5,417,443 | 5/1995 | Blattner et al. . | |
| 5,435,080 | 6/1995 | Meisleman . | |
| 5,446,976 | 9/1995 | Donnadieu et al. . | |
| 5,454,173 | 10/1995 | Falguere et al. . | |
| 5,474,322 | 12/1995 | Perkins et al. . | |
| 5,480,176 | 1/1996 | Sims . | |
| 5,503,900 | 4/1996 | Fletcher | 428/160 |
| 5,505,477 | 4/1996 | Turner et al. . | |
| 5,505,478 | 4/1996 | Napoliello . | |
| 5,520,405 | 5/1996 | Bourke . | |
| 5,520,406 | 5/1996 | Anderson et al. . | |
| 5,577,755 | 11/1996 | Metzger et al. | 280/607 |
| 5,667,237 | 9/1997 | Lauer | 280/607 |
| 5,855,390 | 1/1999 | Hassell | 280/607 |

FOREIGN PATENT DOCUMENTS

| | | |
|---|---|---|
| 0 553 051 A1 | 1/1993 | European Pat. Off. . |
| 0553051 A | 7/1993 | European Pat. Off. . |
| 87 841 B | 9/1993 | European Pat. Off. . |
| WO 9622136 A | 7/1996 | WIPO . |

*Primary Examiner*—J. J. Swann
*Assistant Examiner*—Lynda Jasmin
*Attorney, Agent, or Firm*—Darren J. Jones

[57] ABSTRACT

A snowboard binding for securing a snowboard boot to a snowboard that includes a rigid baseplate, a strap, and an isolation member. The rigid baseplate includes sidewalls and a heel loop extending upwardly therefrom. The baseplate is adapted for attachment to the snowboard and includes a plurality of isolation apertures extending therethrough. A disk aperture is also provided for receiving an attachment disk for fastening the baseplate to the snowboard. The strap is connected to the sidewalls of the baseplate for releasably securing the boot to the binding. The isolation member is formed from a unitary substantially elastic, rubbery material. The isolation member extends beneath the baseplate to substantially isolate the baseplate from the snowboard. The isolation member has a plurality of upward projections extending through the isolation apertures in the baseplate. The upward projections have T-shaped cross sections with head and neck portions. The neck portions extend through the isolation apertures and the head portions extend at least partially above the upper surface of the baseplate.

19 Claims, 4 Drawing Sheets

SNOWBOARD BINDING

FIELD OF THE INVENTION

The present invention relates to improved interfaces between a riding device and a user and, more particularly, to a shock and vibration absorbing snowboard binding.

BACKGROUND OF THE INVENTION

Improving the interface between a snowboard and a snowboarder raises several construct considerations. Designers address these considerations in the details of the snowboard, the snowboard binding, and the snowboard boots. Desirable characteristics may include limited space between the snowboarder's foot and board, a secure attachment to the board, some medial and lateral ankle mobility while maintaining proper attachment and secure feel, vibration and shock absorption, traction of the boot on the binding, a lightweight system, safety, and adjustability. Keeping the snowboarder's foot close to the board improves the rider's feel for the board and riding surface and increases the board's responsiveness as the snowboarder moves their foot. A secure attachment to the board not only enhances the rider's safety, but also effects an efficient transfer of forces which assists the snowboarder in maintaining proper control. A certain amount of medial and lateral movement of the snowboarder's ankle and foot is desirable for stunts and general maneuvering. Limiting rearward movement of the lower leg and limiting boot movement away from the board are also desirable and, at times, compete with lateral mobility concerns. Vibration absorption becomes important as snowboarders ride on hard-packed terrain with increased speeds. The snowboarder may also require shock absorption, especially with jumps and stunts. Traction between boot and binding improves control and results in an efficient transfer of forces to the board from the snowboarder's foot. A lightweight system decreases fatigue and improves performance. Varied terrain and individual rider preferences necessitate the ability to adjust both the angle of the binding and the space between bindings. Snowboard manufacturers and designers have attempted to address all of the above concerns. A conventional binding is disclosed in U.S. Pat. No. 5,356,170 (Carpenter, et al.). This binding includes a baseplate with sidewalls extending upwardly therefrom and a highback pivotally attached to the sidewalls. Additionally, Carpenter's binding contains straps that extend from one sidewall to the other, with buckles to secure or release the snowboard boot from the binding. Several snowboard companies sell bindings similar to those disclosed in the Carpenter, et al. patent. The adjustability of these bindings is provided by a center disk through which screws extend to engage inserts within the snowboard. The central disk may be rotated to change the angular orientation of the binding relative to the board; it also may be moved fore and aft and into other inserts placed within the snowboard. The binding may be somewhat light in weight if constructed of appropriate plastic or other lightweight yet strong materials. Other concerns are more fully addressed by alternative designs and additions to the basic set-up shown in the Carpenter, et al. patent.

For example, a patent to Young (U.S. Pat. No. 5,409,244) is directed toward a baseless snowboard binding. In this patent, Young eliminates the central disk for attachment to the snowboard, but instead provides flanges extending from the sidewalls to secure the binding to the board. This keeps the user's foot closer to the snowboard and may decrease the weight of the binding. However, the binding lacks the adjustability of conventional bindings that have disks or step-in snowboard bindings with disks. Furthermore, as with the Carpenter et al. binding, the Young binding adds no vibration absorption or shock absorption. In order to address vibration and shock absorption, snowboard designers and, more prominently, ski designers, have used rubber or other viscoelastic layers between the binding and the board or ski. For example, U.S. Pat. No. 5,520,406 (Anderson, et al.) uses a gasket (49) between the metal frame of the step-in snowboard binding and the snowboard. The gasket provides some vibration absorption, especially if made of rubber or other elastic material. Other snowboard binding manufacturers have placed rubber, or material softer than the binding frame, on top of the snowboard frame between the binding frame and boot sole. However, all these solutions lift the boot further from the snowboard and do little to absorb shock, while not absorbing as much vibrational energy as would be the case if these materials were thicker. Of course, thicker material would further elevate the rider from the board.

Thick, elastomeric materials have been used with skis, as evidenced by the Mayr patents (U.S. Pat. Nos. 5,143,395 and 5,199,734). Mayr uses an elastomer damping material between the binding and ski, with a binding mounting plate on top of the damping material. In this manner, vibrations can be absorbed in the elastomer without transferring them to the boot and, thus, foot of the skier. Vibration absorption was also addressed in U.S. Pat. No. 5,232,241 (Knott, et al.). In this ski, the binding mounting plate was allowed to move relative to the rest of the ski through the use of an elastomer layer sandwiched between two cores. Other examples in ski art include U.S. Pat. No. 4,896,895 (Bettosini) and U.S. Pat. No. 5,026,086 (Guers, et al.). Transferring this technology to snowboards would necessitate lifting the user's foot away from the board in order to adequately obtain vibration absorption, shock absorption, and traction, while maintaining adjustability and medial and lateral movement. Whereas elevated bindings may enhance ski maneuvering, snowboard riding requires a closeness between the user's foot and board.

Therefore, a need exists for a snowboard binding that does not elevate the rider's foot much further off the board than a conventional binding yet provides significant vibration and shock absorption. Medial and lateral movement, traction, light weight, and adjustability can also be provided with a secure, safe attachment to the board through the present invention.

SUMMARY OF THE INVENTION

The present invention is directed toward a snowboard binding for securing a snowboard boot to a snowboard while providing increased shock and vibration absorption and increased boot traction on the binding. The binding includes a baseplate and a substantially elastic isolation member. The baseplate has a releasable fastener attached thereto for releasably securing the boot. The baseplate is adapted for attachment to a snowboard and includes a first aperture extending therethrough. The isolation member extends beneath the baseplate. It is adapted to be positioned between the baseplate and the snowboard. The isolation member includes a first upward projection extending through the first aperture to at least slightly above at least a portion of the baseplate. The upward projection is positioned to contact the boot.

In the preferred embodiment of the invention, the isolation member extends beneath a substantial portion of the baseplate. Thus, the baseplate is isolated from direct contact with the snowboard. In one aspect, the baseplate also includes a second aperture extending therethrough and the isolation member includes a second upward projection extending through the second aperture. The second upward projection extends to at least slightly above at least a portion of the baseplate and the second projection is positioned to contact the boot. The baseplate includes a forward end and rearward end. The forward end has an upper surface sloping downward and a lower surface to be positioned opposite the board. The first projection extends through the first aperture in the forward end with the top surface of the first projection generally parallel to the lower surface of the baseplate.

In another aspect of the preferred embodiment of the invention, the isolation member is a single piece with the projections integrally attached. The baseplate also includes a disk aperture for receiving an attachment disk for securing the baseplate to the snowboard. The isolation member includes an opening adjacent the disk aperture to allow fasteners to connect the attachment disk to a snowboard without interruption by the isolation member. Preferably, the isolation member is made of an elastomeric material including at least rubber.

In another aspect of the invention, the upward projections have T-shaped cross sections forming projection heads and projection necks. The projection necks extend through the baseplate apertures. The baseplate apertures further include widened portions at their upper end to receive a portion of the projection heads therein. The projection heads are preferably disposed at least partially above the first aperture and are wider than at least a portion of the first aperture. In one aspect of the invention, the baseplate includes a recess for receiving a portion of the projection head above the first aperture.

In another preferred aspect of the invention, the isolation member is substantially elastic, while the baseplate is substantially rigid. The isolation member preferably has a lower durometer hardness than the baseplate in order to provide shock and vibration absorption as well as traction for the snowboard boot. Since the isolation member extends from beneath the baseplate through the apertures in the baseplate and contacts the sole of the snowboard boot, significant shock and vibration absorption is possible while isolating the boot from the baseplate of the binding. The boot gets better traction on the lower durometer isolation member material which also provides some lateral and medial flexibility for the boot sole relative to the snowboard.

The isolation member of the present invention may be used with a baseplate on any type of binding, whether conventional or step-in.

BRIEF DESCRIPTION OF THE DRAWINGS

The foregoing and additional features and advantages of the present invention will be more readily appreciated if the same becomes better understood from the detailed description when considered in conjunction with the following drawings, wherein.

DETAILED DESCRIPTION OF THE PREFERRED EMBODIMENT

Figure 1:
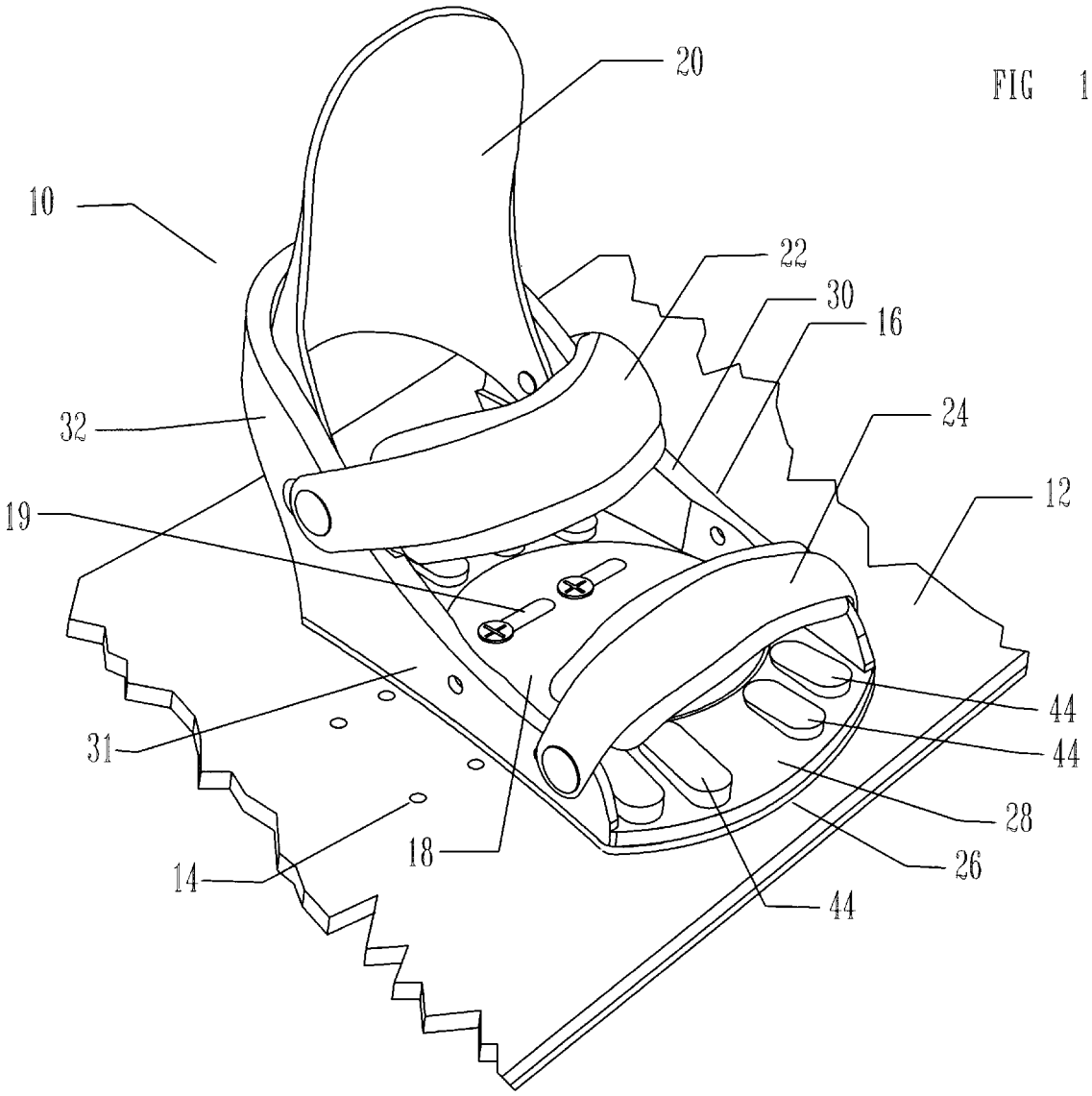
FIG. 1 is a perspective view of the binding of the present invention shown mounted on a snowboard.

Referring to FIG. 1, a preferred embodiment of a binding 10 of the present invention is illustrated in a ready-to-use configuration attached to a snowboard 12. Conventional snowboards include inserts 14 within the body thereof into which fasteners are secured to hold binding 10 to the top surface of the board. To ride the snowboard, the snowboarder secures the snowboard boot (not shown) with foot inside onto binding 10.

Binding 10 includes a baseplate 16, a rotodisk 18, a highback 20, an ankle strap 22, a toe strap 24, and an isolator 26. Baseplate 16 is the main structural body of binding 10 and is secured to snowboard 12 with rotodisk 18. Rotodisk 18 includes rotodisk slots 19 extending parallel to each other in a configuration that matches the pattern of inserts 14 on snowboard 12. Rotodisk 18 is a preferred way of attaching binding 10 to snowboard 12. However, alternative ways of fastening may be employed without destroying the purpose and function of the present invention.

As with conventional bindings, a preferred embodiment of binding 10 also includes highback 20 attached at the heel end thereof. Highback 20 limits the rearward movement of the lower leg of the snowboarder in order to provide adequate support in this direction. Ankle strap 22 extends across binding 10 forward of highback 20. Ankle strap 22 is positioned above and in front of the ankle area of the snowboarder and functions to hold the heel of the boot in place on binding 10. Toe strap 24 secures the toe end of the boot to binding 10. Isolator 26, illustrated in FIG. 1, provides both vibration and shock absorption for the rider as well as providing traction to the snowboard boot while not appreciably increasing the weight of binding 10 or height of the snowboard boot off of snowboard 12. Isolator 26 will be discussed in more detail below.

Figure 2:
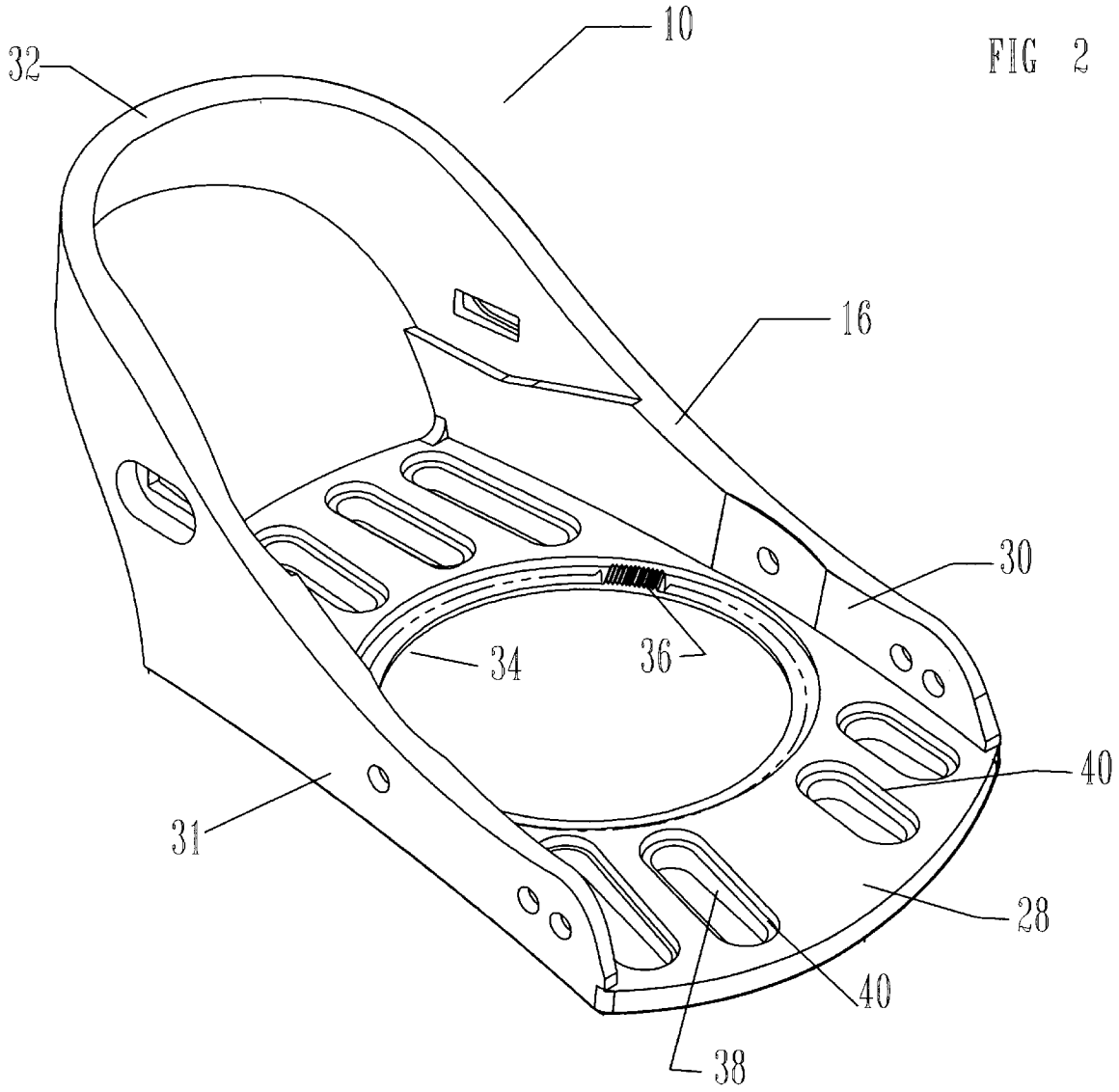
FIG. 2 is an isometric view of the baseplate with heel loop of the binding, shown without the isolator.

Baseplate 16 includes a platform 28, lateral and medial sidewalls 30 and 31, a heel loop 32, and a rotodisk opening 34 (shown in FIG. 2). Platform 28 extends as a base portion of baseplate 16 generally in a plane parallel to the upper surface of snowboard 12. Platform 28 extends beneath portions of the sole of the snowboard boot. In the preferred embodiment of the invention, platform 28 is generally rectangular in shape with a cut-out forming rotodisk opening 34 in approximately the center thereof. Thus, platform 28 is divided into a toe end and a heel end on either side of rotodisk opening 34. The toe end of platform 28 slopes slightly downwardly toward the toe end of binding 10 with a reduction in material and subsequent reduction in weight of binding 10. Lateral sidewall 30 extends upwardly along the side of platform 28 to form a rail along the lateral side of the snowboard boot to hold the boot in position. Medial sidewall 31 likewise extends upwardly along the medial side of the boot and binding 10. Ankle and toe straps 22 and 24 are secured to sidewalls 30 and 31 with fasteners. In the preferred embodiment, sidewalls 30 and 31 extend generally perpendicular to platform 28 with the toe ends of sidewalls 30 and 31 being approximately one inch tall and increasing in height toward the heel end of platform 28. As sidewalls 30 and 31 extend rearwardly, they form heel loop 32 which connects sidewalls 30 and 31 at the heel end of binding 10. As sidewalls 30 and 31 extend rearwardly to form heel loop 32, they extend above and rearward to platform 28 such that heel loop 32 forms an opening between heel loop 32 and platform 28. Preferably, a lower portion of highback 20 extends around heel loop 32 adjacent thereto. As seen in FIG. 2, rotodisk opening 34 includes teeth 36 extending around rotodisk opening 34 on platform 28 within a slight recess formed therein. Teeth 36 are conventional in construction and adapted to secure a somewhat conventional rotodisk 18 in the preferred embodiment of the invention. Rotodisk opening 34 is round to correspond with the round shape of rotodisk 18 to enable angular reorientation of binding 10 relative to snowboard 12.

A prominent feature of the present invention is facilitated by platform 28 of baseplate 16 having receiver slots 38 extending therethrough. Receiver slots 38 are provided within platform 28 and extend entirely through platform 28 such that isolator 26 may extend therethrough. In the preferred embodiment of the invention, receiver slots 38 are oblong in shape and extend generally parallel to the longitudinal axis of baseplate 16. In the preferred embodiment, four such receiver slots 38 of varying length are provided at the toe end of platform 28 and four are provided at the heel end of platform 28. Alternative constructions may employ, instead of slots, circles, triangles, or any other regular or irregular geometric shape extending through platform 28. Furthermore, the receiver slots need not be bound on one end or the other. For example, receiver slots 38 in the toe end of platform 28 could actually extend to the forwardmost end such that they are not bound on their toe ends, but are open to receive isolator 26. The upper ends of receiver slots 38 include recesses 40 circumscribing the through portion of receiver slots 38.

Figure 3:
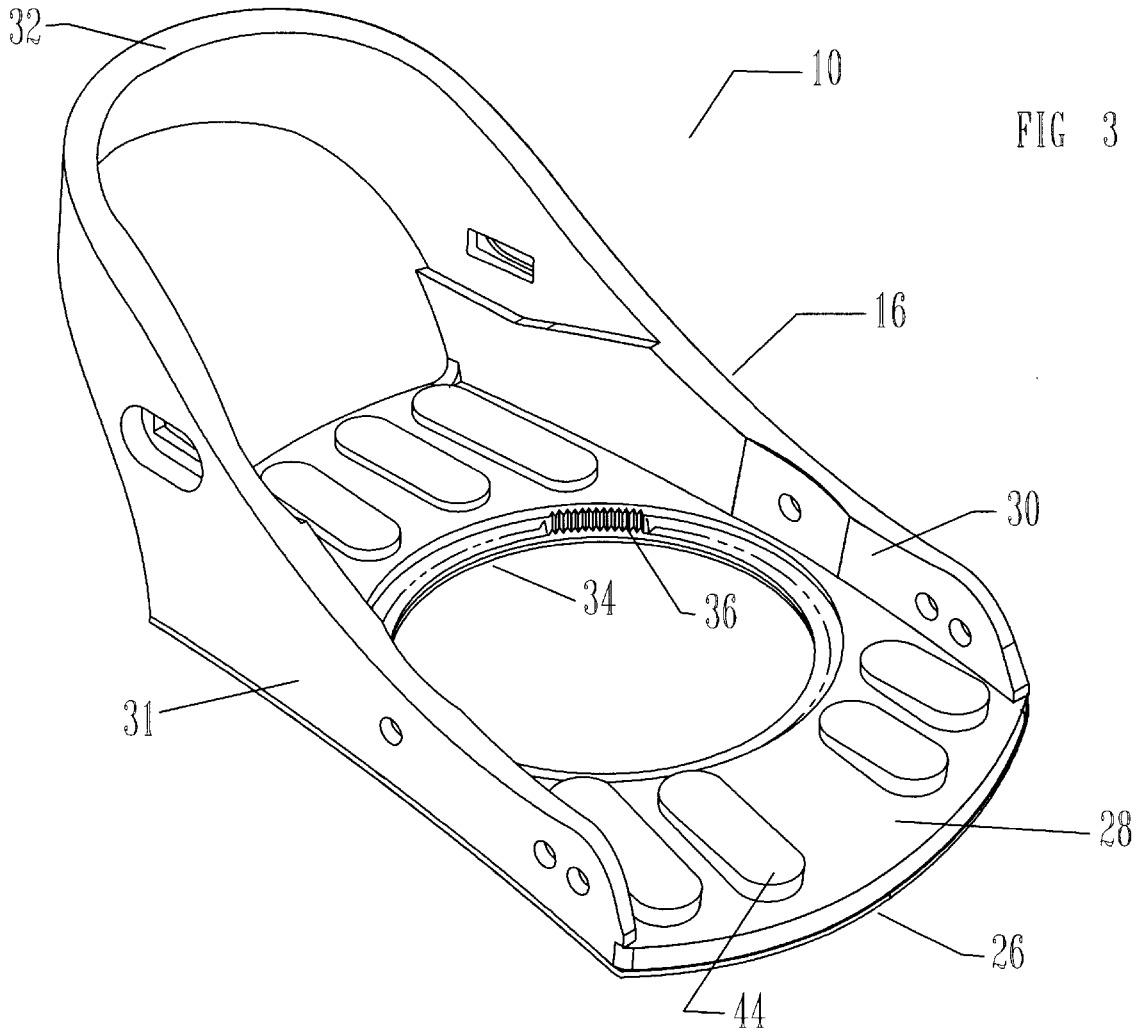
FIG. 3 is an isometric view of the baseplate with the isolator in place.
Figure 4:
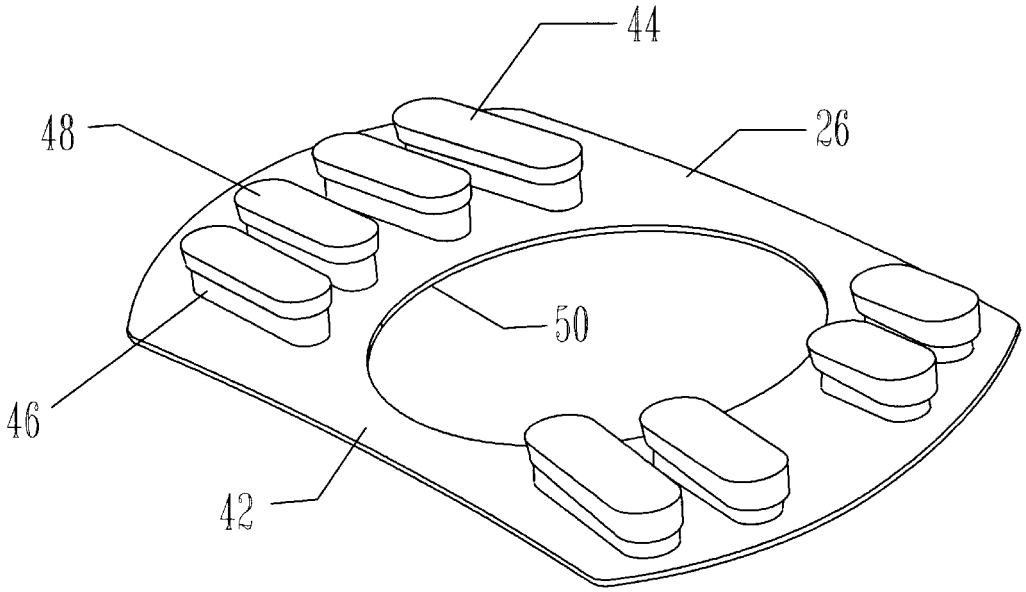
FIG. 4 is an isometric view of the isolator separate from the baseplate.

Referring now to FIGS. 3 and 4, the isolator 26 includes an isolator platform 42, isolator pads 44 and an isolator opening 50. This is the preferred embodiment of isolator 26 for use with a somewhat conventional snowboard binding as illustrated in FIG. 1. Isolator platform 42 extends beneath substantially the entire bottom surface of platform 28 to provide an isolation layer between platform 28 of baseplate 16 and snowboard 12. Thus, high frequency vibrations that travel along snowboard 12 are isolated from baseplate 16 and the snowboarder. Isolator opening 50 is provided within isolator platform 42 to enable rotodisk 18 to allow adjustability of binding 10 on snowboard 12. Alternatively, a smaller opening or other arrangement could be made on isolator platform 42 depending upon the construction of baseplate 16 and the adjustability features desired.

As seen in FIGS. 3 and 4, isolator pads 44 extend upwardly from isolator platform 28. Isolator pads 44 include necks 46 and heads 48. Heads 48 are somewhat wider than necks 46 and are seated within recesses 40 of platform 28. Recesses 40 help to limit compression and retain isolator 26 attached to baseplate 16. Recesses 40 also limit lateral movement of heads 48. Necks 46 extend within receiver slots 38 of platform 28 as shown in FIG. 1 and FIG. 4. Heads 48 of isolator pads 44 are slightly taller than recesses 40 such that they project above the main surface of platform 28 to at least partially isolate the boot (not shown) from direct contact with platform 28. In this manner, an isolation connection between the snowboard boot and snowboard 12 is provided. Thus, not only is vibration absorption significantly increased, but shock absorption is increased because of the vertical height of isolator pads 44 which can extend all the way from the top surface of snowboard 12 to the sole of the snowboard boot without being interrupted by baseplate 16. Furthermore, by extending isolator pads 44 through platform 28 of baseplate 16, this extra vibration and shock absorption is allowed without significantly increasing the vertical displacement of the snowboard boot above snowboard 12.

Depending on the durometer hardness selected for isolator 26, medial and lateral movement of the snowboard boot relative to snowboard 12 and baseplate 16 can also be provided. Increased traction also results from a direct interface between isolator pads 44 and the outsole of the snowboard boot. In addition, since grooves or other means of attaching a separate pad to the top of platform 28 are not required, the overall system maintains a high level of reliability.

Note that several changes could be made to isolator 26 and it would still function in a desired manner. For example, in the preferred embodiment, isolator 26 is a unitary piece with isolator platform 42 interconnecting each of isolator pads 44. However, each of isolator pads 44 could be independent and have its own smaller isolator platform 42 as a flange at the lower end thereof. Thus, isolator pads of varying durometers could be used together, instead of simply replacing the entire isolator 26 with another isolator of differing durometer hardness.

As mentioned above, the toe end of platform 28 of baseplate 16 slopes slightly downwardly. In the preferred embodiment of isolator 26 of the present invention, heads 48 of the pads 44 increase in thickness at the toe end of isolator 26 such that the upper surfaces of isolator pads 44 lie within a plane generally parallel to the upper surface of snowboard 12. Thus, the weight of baseplate 16 can be reduced while still maintaining a desirable interface with the snowboard boot.

Also, note that the isolator of the present invention could be used with unconventional binding constructions, such as step-in bindings. The principles of isolating the main structural body or framework of the binding from the board and somewhat from the snowboard boot to increase vibration and shock absorption as well as traction would still be accomplished in these alternative constructions and would fall within the present invention.

Thus, while the preferred embodiment of the invention has been illustrated and described, it will be appreciated that various changes can be made therein without departing from the spirit and scope of the invention. The embodiment shown and described is for illustrative purposes only and is not meant to limit the scope of the invention as defined by the claims.

The embodiment of the invention in which an exclusive property or privilege is claimed is defined as follows:

1. A snowboard binding for securing a snowboard boot to a snowboard comprising:

(a) a rigid baseplate having a releasable fastener attached thereto for releasably securing the boot to the baseplate, said baseplate being adapted for attachment to the snowboard, said baseplate to be positioned between the snowboard and the boot, said baseplate having a top surface and including a first aperture extending therethrough; and (b) a substantially elastic isolation member extending beneath said baseplate and positioned between said baseplate and said snowboard, said isolation member including a first upward projection having a lower portion extending through said first aperture and an upper portion projecting above at least a portion of the top surface of the baseplate for supportingly engaging with the bottom surface of the boot, the upper portion of the first upward projection being compressible by the boot for reducing shock and vibration while at least partially isolating the boot from the top surface of the baseplate.

2. The snowboard binding of claim 1, wherein said isolation member extends beneath a substantial portion of said baseplate to isolate said baseplate from direct contact with said snowboard.

3. The snowboard binding of claim 2, wherein said baseplate further comprises a second aperture extending therethrough and wherein said isolation member further comprises a second upward projection extending through said second aperture to at least slightly above at least a portion of said baseplate, said second upward projection being positioned to contact the boot.

4. The snowboard binding of claim 3, wherein said baseplate includes a forward end and a rearward end, said forward end having an upper surface sloping downward and a lower surface, said first projection extending through said first aperture in said forward end, said first projection having a top surface generally parallel to the lower surface of said baseplate.

5. The snowboard binding of claim 3, wherein said isolation member is a single piece having said projections integrally attached, wherein said baseplate includes a disk aperture for receiving an attachment disk for securing said baseplate to the snowboard, and wherein said isolation member includes an opening adjacent said disk aperture.

6. The snowboard binding of claim 5, wherein said isolation member comprises rubber.

7. The snowboard binding of claim 3, wherein said upward projections have T-shaped. cross sections forming projection heads and projection necks, said projection necks extending through said baseplate apertures, said baseplate apertures further including widened portions at their upper ends to receive a portion of said projection heads therein.

8. The snowboard binding of claim 1, wherein said isolation member comprises a rubber material.

9. The snowboard binding of claim 8, wherein said isolation member comprises a single, unitary piece of material.

10. The snowboard binding of claim 1, wherein said isolation member comprises an elastomer.

11. The snowboard binding of claim 1, wherein said first upward projection is T-shaped in cross section, said first upward projection having a head and a neck, said head being disposed at least partially above said first aperture and being wider than at least a portion of said first aperture.

12. The snowboard binding of claim 11, wherein said baseplate includes a recess for receiving a portion of said projection head above said first aperture.

13. The snowboard binding of claim 12, wherein said baseplate includes a bottom surface and a top surface with a generally downwardly sloping end, said projection head being disposed adjacent said sloping end and configured to remain substantially parallel to said bottom surface.

14. A snowboard binding for securing a snowboard boot to a snowboard comprising:

(a) a rigid baseplate having a releasable fastener attached thereto for releasably securing the boot to the baseplate, said baseplate being adapted for attachment to the snowboard, said baseplate to be positioned between the snowboard and the boot, said baseplate having a top surface and including a plurality of apertures extending therethrough; and (b) an isolation member extending beneath said baseplate and positioned between said baseplate and said snowboard, said isolation member being substantially elastic and having a lower durometer hardness than said baseplate, said isolation member including a plurality of upward projections having a plurality of lower portions extending through said plurality of apertures and a plurality of upper portions projecting above at least a portion of the top surface of the baseplate apertures for supportingly engaging with the bottom surface of the boot, the upper portions of the plurality of upward projections being compressible by the boot for reducing shock and vibration while at least partially isolating the boot from the top surface of the baseplate.

15. The snowboard binding of claim 1, further comprising sidewalls attached to the sides of said baseplate and extending upwardly therefrom and wherein said releasable fastener includes a highback attached thereto and at least one strap secured to at least one of said sidewalls for releasably securing the boot.

16. The snowboard binding of claim 1, wherein said isolation member comprises a single, unitary piece of material.

17. The snowboard binding of claim 16, wherein said baseplate includes a disk aperture for receiving an attachment disk for securing said baseplate to the snowboard, and wherein said isolation member includes an opening adjacent said disk aperture.

18. The snowboard binding of claim 16, wherein said upward projections are T-shaped in cross section, said upward projections having heads and necks, said heads being disposed at least partially above said apertures and being wider than at least a portion of said apertures.

19. A snowboard binding for securing a snowboard boot to a snowboard comprising:

(a) a rigid baseplate having sidewalls and a heel loop extending upwardly therefrom, said baseplate being adapted for attachment to the snowboard, said baseplate including a plurality of isolation apertures extending therethrough and having a disk aperture for receiving an attachment disk for fastening said baseplate to the snowboard;

(b) a strap connected to said sidewalls for releasably securing the boot to the binding; and (c) a unitary, substantially elastic isolation member extending beneath said baseplate to substantially isolate said baseplate from said snowboard, said isolation member having a plurality of upward projections extending through said plurality of isolation apertures in said baseplate, said upward projections having T-shaped cross sections with head and neck portions, said neck portions extending through said isolation apertures, said head portions extending at least partially above the upper surface of said baseplate.

* * * * *